US005527422A

United States Patent [19]

Lehmann et al.

[11] Patent Number: 5,527,422

[45] Date of Patent: Jun. 18, 1996

[54] MACHINE FOR CONTINUOUS MANUFACTURE OF CHIPBOARDS, FIBREBOARDS OR SIMILAR PRODUCTS

[75] Inventors: Rolf Lehmann, Rudolfstetten; Eugen Schnyder, Waltenschwil, both of Switzerland

[73] Assignee: Sulzer-Escher Wyss AG, Zurich, Switzerland

[21] Appl. No.: 249,517

[22] Filed: May 26, 1994

[30] Foreign Application Priority Data

Aug. 4, 1993 [EP] European Pat. Off. ..... 93202303

[51] Int. Cl.[6] ..... B30B 5/04

[52] U.S. Cl. ..... 156/555; 156/583.3; 156/583.5; 156/583.91; 100/93 RP; 100/153; 425/373; 492/16; 492/7

[58] Field of Search ..... 156/555, 583.1, 156/583.3, 583.5, 583.91; 100/93 P, 93 RP, 153; 425/371, 373; 492/16, 2, 5, 6, 7

[56] References Cited

U.S. PATENT DOCUMENTS

| | | | |
|---|---|---|---|
| 4,848,119 | 7/1989 | Pav et al. | 492/2 X |
| 4,852,229 | 8/1989 | Crouse | 492/5 X |
| 4,856,154 | 8/1989 | Nikulainen et al. | 492/16 X |
| 4,992,133 | 2/1991 | Border | 156/498 |
| 5,242,361 | 9/1993 | Brown et al. | 492/7 |
| 5,272,967 | 12/1993 | Held | 100/93 P |

FOREIGN PATENT DOCUMENTS

| | | |
|---|---|---|
| 1374001 | 8/1964 | France . |
| 2549560 | 5/1977 | Germany . |
| 3800513A1 | 7/1989 | Germany . |
| 1193156 | 5/1970 | United Kingdom . |
| WO92/19809 | 11/1992 | WIPO . |

*Primary Examiner*—David A. Simmons
*Assistant Examiner*—J. Sells
*Attorney, Agent, or Firm*—Townsend and Townsend and Crew

[57] ABSTRACT

A machine for the manufacture of chipboards or fibreboards comprises a pressure drum (1) and an endless steel belt (2) which wraps the pressure drum (1) around part of its periphery and forms there a compacting line (P) in which is for a sufficiently long time compacted and cured, by the action of pressure and temperature, material which is brought into it and which comprises lignocellulose or cellulose, is reduced to chips or fibres and is provided with an adhesive curable by heat. The compacting pressure and the heating are produced by extensive pressure shoes (10, 13, 14, 15) comprising a hydrostatic bearing pocket (11) supplied with hot pressurised oil. The pressure drum (1) is provided with a non-rotatable carrier (19) and a jacket (20) which is rotatable about it and is supported by supporting elements (21) supplied with hot pressurised oil, so that the jacket (20) is simultaneously heated and adjustable pressure forces without bearing loading are produced, while a uniform smooth gap is obtained.

10 Claims, 1 Drawing Sheet

MACHINE FOR CONTINUOUS MANUFACTURE OF CHIPBOARDS, FIBREBOARDS OR SIMILAR PRODUCTS

BACKGROUND OF TEH INVENTION

The invention relates to a machine for the continuous manufacture of chipboards, fibreboards or similar products from a raw material containing lignocellulose or cellulose which has been reduced to chips or fibres and mixed with an adhesive curable by pressure and/or heat. The machine comprises a heatable pressure drum and an endless metallic pressure belt, which is guided on deflection .rollers and wraps the pressure drum over a portion of its periphery while forming a compacting line for the material to be compressed. The material is heated to a temperature above the curing temperature of the adhesive, a pressure device being provided to exert onto the pressure belt a predetermined compacting pressure acting over an area according to earlier patent application No. 93810458.5.

Such machines are known for instance from EP 195 128, EP 324 070, DE 25 49 560 or DE 38 00 513. They serve to process waste material available in large quantities, such as wood refuse, sugar cane bagasse, cotton stalks or similar material, to chipboards or fibreboards or similar products for use in the building or furniture industry. For this purpose, the raw material containing lignocellulose or cellulose is reduced to chips or disintegrated to fibres in a cleaned and largely dried form mixed with a suitable adhesive. A a particularly suitable material for the adhesion of cellulose fibres and production of strong chipboards (Medium Density Fibre-Board) are, for instance, copolymers of sodium lignosulphonate, melamine and formaldehyde, which gradually cure at a temperature of about 130° C.

For the production of chipboards or fibreboards, the raw material, mixed with adhesive, is brought on to the belt into the compacting line between the belt and the pressure drum moving synchronously therewith, where they are by the action of pressure and temperature compressed and gradually cured, before they are removed from the pressure drum and cut to the desired board size.

In the known machines a pressure roller is provided at the inlet end, i.e., at the inlet of the raw material into the compression zone, which pressure roller exerts onto the belt a nearly linear pressure force with a compacting. pressure considerably above 100 bar. After this inlet end, the pressure roller follows a zone in which the compacting pressure is produced only by the belt tension and after that follows a further pressure roller which also exerts a nearly linear force. Usually three to four rollers are provided, of which the last roller serves to form the produced boards shortly before the end of the curing process. A disadvantage of this known process is that, due to the sudden pressure loading and following zones of small pressure due to multiple springing back of the fibres, an insufficient strength, an undesirable density profile and insufficient hardness distribution across the thickness of the board result and also an unnecessarily large amount of the adhesive must be used.

A further disadvantage is that in the known machines; is that the pressure drum and the pressure rollers cannot be sufficiently heated to transfer enough heat to the material, from which follows that the belt must be brought to the sufficient temperature by additional heating means.

It is especially disadvantageous in the known machines that large forces can act on the bearings of the pressure drum. This requires mounting of the individual pressure rollers such that the bearing forces of the pressure drum are at least partly compensated, but by adjustment to other operational conditions the equalization of forces would be disturbed. It is further disadvantageous that the pressure rollers deform the pressure drum to such an extent that it is not possible to keep narrow tolerances. In order to keep sagging of the pressure drum as small as possible when high forces act on it, a considerable wall thickness of the pressure drum in the decimeter region is needed, which brings the weight of the pressure drum to more than 100 metric tons. In spite of that the sagging of the pressure drum is still so extensive that the thickness of the produced chipboards across the width unacceptably varies and its shape is bent, i.e. departs from a plane.

SUMMARY OF THE INVENTION

The aim of the invention is to avoid the above mentioned disadvantages of the state of the art and particularly further develop a machine for the continuous manufacture of chipboards, fibreboards or similar products of the initially mentioned kind in such a way that a more uniform thickness across the width of the produced chipboard or fibreboard or a desired thickness profile may thereby be achieved. In addition, it is an object of the present invention to produce a planar chipboard to obtain greater strength and more homogenous density and hardness distribution across the thickness of the chipboard or fibreboard, while the material in the compacting line is heated in a simple way above the curing temperature of the adhesive and extreme bearing forces are avoided.

This aim is achieved according to the invention in that the pressure drum has a non-rotatable carrier and a jacket which is rotatable with respect to the carrier and is supported by at least one support device with adjustable support force. Thus, sagging of the jacket is avoided and the bearing forces on the drum journals are significantly reduced or avoided.

The support devices are preferably hydraulic, and include support elements supplied with heated pressurised medium and having individually adjustable supporting force.

The pressure device is preferably formed at least at the inlet end of the compacting line by a pressure shoe with a hydraulic bearing area, which forms with the pressure drum a gradually contracting inlet zone and following compacting line region which extends about a portion of the periphery of the pressure drum with a nearly uniform compacting pressure and/or spacing from the pressure drum, whereby the uniformity of the chipboards is further improved.

In a preferred embodiment of the invention, further pressure shoes are provided immediately at the pressure shoe at the inlet end. The further pressure shoes exert on the pressure belt a pressure successively decreasing in steps. A forming roller may be provided downstream of this on the outlet end of the boards with a linear force controllable across the width in order to achieve shortly before the end of the curing process the desired thickness profile or a predetermined surface shape.

BRIEF DESCRIPTION OF THE DRAWING

The FIG. 1 is a side view of the machine of the invention.

DESCRIPTION OF THE PREFERRED EMBODIMENT

Figure 1:
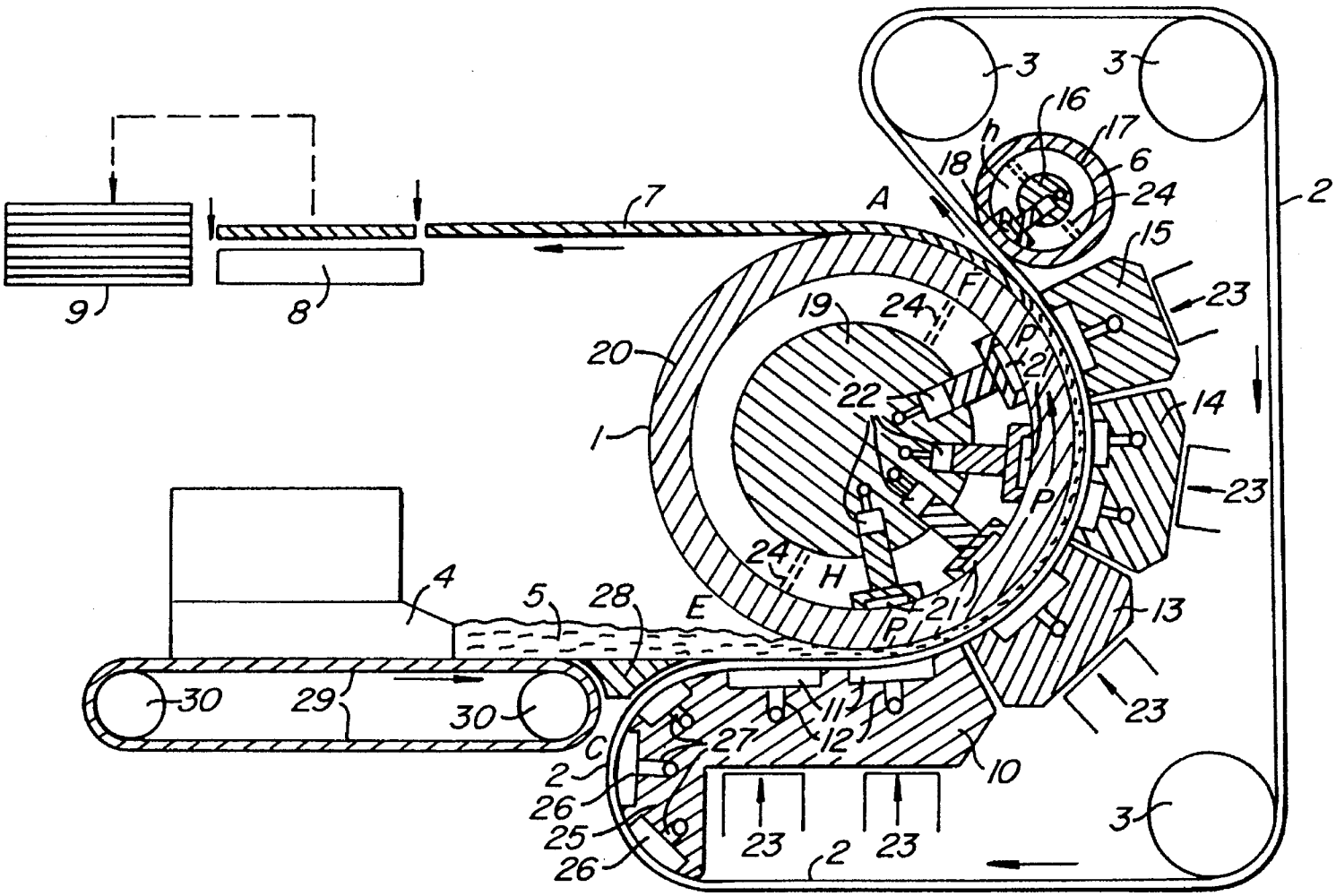

The invention will now be described in greater detail, by way of example, with reference to the embodiment of a machine for the manufacture of chipboards, fibreboards or similar products illustrated in the accompanying FIGURE.

The machine comprises a pressure drum 1 and an endless metallic pressure belt 2, for instance a steel belt, which is guided continuously across a portion of the periphery of the pressure drum 1 over several deflection rollers 3, so that it forms along the wrapped portion of the pressure drum 1 with the latter a compacting line P. The pressure drum 1 and the pressure belt 2 move in the compacting line P synchronously with each other.

A material 5, which contains lignocellulose or cellulose, is reduced to chips or fibres and is mixed with an adhesive curable by heat, is supplied from a hopper 4, by means of a conveyor belt 29 guided over deflection rollers 30, across a guiding member 28 onto the upper surface of the pressure belt 2, which extends here horizontally, with a certain predetermined weight per unit area and travels on the pressure belt 2 into the inlet zone E of the compacting line P, a compressing pressure. In the compacting line P acts on the introduced material and the material is, at the same time, heated above the curing temperature of the adhesive. While passing through the compacting line P the material is compressed to the desired density and during the time of its passage therethrough is nearly cured. At the end F of the compacting line P, shortly before the outlet A, the board being formed is subjected, by a forming roller 6, to final compression and obtains the desired thickness profile or the desired surface quality or texture. The chipboard or fibreboard 7, which leaves the outlet zone A and is still endless, is cut in a cutting device 8 to the desired size and deposited on a stack 9.

The pressure drum 1 is provided with a drum jacket 20 rotatable about a non-rotatably mounted carrier 19. The jacket 20 is supported with respect to the carrier 19 by at least one support device 21. Because no journal bearings are provided and the forces are absorbed via the mounting of the carrier 19, the problem of compensation of the bearing forces in this embodiment is avoided. The support devices 21 may be made in a known manner as following hydrostatic supporting elements supplied from pipes 22 with pressure medium, the pressure of which is controllable. The support elements exert an adjustable supporting force onto the jacket 20 and ensure a nearly frictionless mounting of the rotating drum jacket 20, or are made as other known supporting elements, possibly also as rolling bodies. The support elements 21 may be made as continuous support strips or as individually controllable support elements arranged one next to each other in axial direction. Several support strips or rows of support elements 21 may be provided next to each other also in peripheral direction. The sides of the pressure drum 1 are preferably closed by flexible, e.g. bellow-shaped sealings. Instead of this the whole half-space which faces the compacting line P and is situated between the carrier 19 and the drum jacket 20, or a partial space, may be, as a support device, filled with pressurised fluid. The pressurised medium of the support elements 21 is preferably heated to such a temperature that the drum jacket is heated to a temperature above the curing temperature of the adhesive, whereby a sufficiently intensive heating of the material 5 in the compacting line P is ensured. In addition, the wall thickness of the jacket 20 of the pressure drum 1 is considerably reduced, e.g. to the order of 5 cm, and the weight of the pressure drum is reduced from much more than 100 metric tons to less than 50 metric tons. Additionally, as a result of the reduction of the wall thickness, the heat transfer is improved and the energy consumption is reduced. By the planned adjustment of the compacting pressure of the pressure shoes 10, 13, 14, 15 and the support elements 21, the sagging of the drum jacket 20 under the enormous pressing forces may be avoided, so that the thickness constancy of the chipboard 7 is considerably improved and the wear of the pressure belt 2 is reduced.

At the inlet E into the compacting line P is provided a pressure shoe 10 for the formation of the compacting line P between the pressure drum 1 and the pressure belt 2, for exerting the necessary compacting pressure and for heating the pressure belt 2 and the material layer 5 transported thereon. The surface of the pressure shoe facing the pressure belt 2 is so shaped, that a gradually narrowing funnel-shaped gap is formed at the inlet E into the compacting zone P between the pressure belt 2 and pressure drum 1, while in the following compacting line P is established a nearly uniform spacing between the pressure belt 2 and the pressure drum 1. At the inlet E is generated an initially increasing compacting pressure which is in the following compacting zone P maintained nearly at a certain pre-determined pressure value during the whole time of movement across the pressure shoe 10.

In comparison with machines having at the inlet end a pressure roller which contacts the pressure drum 1 substantially nearly linearly and consequently produces only a brief pressure peak at the inlet to the compression gap, after which the pressure drops to a low value and enables springing back of the fibres, in the described embodiment the pressure in the compacting line P is maintained for a much longer period without undesirable pressure peaks and interruptions. Thus, the chipboards, manufactured in this way, have a much better homogeneity as regards their density and hardness distribution and exhibit better fibre cohesion with reduced contents and consumption of adhesive.

The surface of the pressure shoe 10 facing the pressure belt 2 is preferably provided with one or more hydrostatic bearing pockets 11 which are supplied from pressure pipes 12 at a certain pressure with a lubricant, for instance a sufficiently temperature resistant pressurised oil. In this way the pressure belt 2 is hydrostatically supported on the surface of the pressure shoe 10 and can slide nearly without friction across the surface of the pressure shoe. By the pressure, which is set in the bearing pockets 11, may be simultaneously set the compacting pressure needed in the compacting line P. It is further advantageous to heat the supplied pressurised oil to a temperature above the curing temperature of the adhesive, e.g., to a temperature above 150° C., so that also the pressure belt 2 during sliding across the bearing pockets 11, and the material 5 transported thereon, are thereby maintained at a temperature above the curing temperature. A preliminary heating of the pressure belt 2 is obtained in that the front side 25 of the pressure shoe 10 comprises a preheating zone C across which the belt 2 is guided upstream of the inlet zone E, where the latter is also provided with hydrostatic bearing pockets 26 supplied with hot pressurised oil from pipes 27.

In principle, it is often sufficient to provide a single sufficiently long pressure shoe 10. Preferably, however, further analogically designed pressure shoes 13, 14 and 15 may be provided in the compacting line P downstream of the pressure shoe 10 at the inlet end, the additional shoes following one after another practically without interruption. The bearing pockets of these downstream situated pressure shoes 13, 14 and 15 may be supplied with pressurised oil under different pressure, so that a compacting pressure decreasing successively in steps may be generated, e.g. at the pressure shoe 10 at the inlet end a compacting pressure of 30–50 bar, which in the downstream situated pressure shoes decreases in steps to 2–3 bar. By the distribution of the compacting pressure onto the whole compacting line, instead of fewer linear loadings, a disturbing dish-shaped deformation of the pressure drum in peripheral direction is avoided.

The pressure shoes 10, and also 13, 14 and 15, may be situated with respect to the pressure drum 1 in a stationary position with a predetermined spacing or they may be displaceable by adjustment devices 23 with respect to the pressure drum 1 so as to adjust the gap in the compacting line P in the direction of pressure. This may be achieved either manually by means of spindles or automatically by electric, magnetic, pneumatic or hydraulic control. In the last mentioned case they may be movable on hydraulic pressure spaces supplied with pressure medium whose pressure is adjustable, while the same pressure medium may be used which is used for supplying the bearing pockets 11.

At the end of the compacting line P may be provided a forming roller 6 which, by exertion of a pressure which is higher than that of the last pressure shoe 15, gives to the already largely cured chipboard 7 definitively the desired shape and conditions, for instance the desired thickness profile. The forming roller is preferably provided with a jacket 17, which is rotatable about a non-rotatably mounted carrier 16 and which is supported by one or more support elements 18 with adjustable supporting force in the direction of pressing against the carrier 16. The support element 18 may be a continuous support strip or several support elements situated one next to each other in axial direction, by means of which a predetermined thickness profile may be produced. The support elements 18 may be designed, in a manner known per se, as following hydrostatic support elements with an individually controllable pressure force or, in another known manner, or the whole half-space h at the pressure side is designed as a pressure chamber closed by sealing strips 24. The forming roller 6 may be adjustable in the direction of drum circumference in order to vary the curing path. However, also the last pressure shoe may serve as a forming element, as long as it exerts a compacting pressure sufficient for formation, in which case a forming roller may be dispensed with. By making the pressure drum and the forming roller as the so-called sag-equalisation rollers a more uniform and planar pressure gap may be obtained and thereby a more uniform thickness and planar shape of the produced chipboards.

We claim:

1. A machine for manufacturing laminates from a raw material comprising:

a heatable pressure drum having a non-rotatable carrier with a longitudinal axis and a jacket with a periphery circumscribing the carrier, the drum including a plurality of support elements rotatably supporting said jacket with respect to said carrier, said elements being angularly spaced from each other about said carrier and exerting an adjustable supporting force against said jacket;

an endless pressure belt having inner and outer sides and being guided on a plurality of deflection rollers such that a portion of the periphery of the jacket forms a compacting line between the outer side of the belt and the jacket; and a plurality of pressure devices arranged to exert a predetermined compacting pressure against the inner side of the belt opposite the jacket for compressing the raw material between the jacket and the belt.

2. The machine of claim 1 wherein the support elements are adjacent each other in the axial direction and include means for individually adjusting the supporting force against the jacket.

3. The machine of claim 1 wherein the jacket and the carrier define an annular space therebetween, the pressure drum further including a sealing strip dividing the annular space into first and second half-spaces, the first halfspace being located closer to the belt and being filled with pressurized fluid to support the jacket against the belt.

4. The machine of claim 1 wherein one of the pressure devices is a pressure shoe formed at an inlet end of the compacting line and having a hydraulic bearing area, the pressure shoe forming a gradually contracting inlet zone.

5. The machine of claim 4 wherein the pressure devices include at least a second pressure shoe downstream of the first pressure shoe and having a hydraulic bearing area with adjustable compacting pressure, the pressure shoes exerting a substantially uniform compacting pressure and being positioned at a substantially uniform distance from the pressure drum.

6. The machine of claim 1 further comprising a forming roller positioned downstream of the pressure devices, the forming roller exerting a compacting pressure on the belt that is greater than the compacting pressure exerted by the pressure devices.

7. The machine of claim 6 wherein the forming roller comprises a non-rotatable Carrier, a rotatable jacket and at least one support element for rotatably supporting the jacket with respect to the carrier, the support element exerting an adjustable support force on the jacket.

8. The machine of claim 7 wherein the support elements are adjacent each other in the axial direction and include means for individually adjusting the supporting force against the jacket.

9. The machine of claim 7 wherein the forming roller is displaceable in a direction of movement of the belt.

10. The machine of claim 7 wherein the jacket and the carrier of the forming roller define an annular space therebetween, the forming roller further including a sealing strip dividing the annular space into first and second half-spaces, the first half-space being located closer to the belt and being filled with pressurized fluid to support the jacket against the belt.

* * * * *